US007042416B2

(12) United States Patent
Kingsley et al.

(10) Patent No.: US 7,042,416 B2
(45) Date of Patent: May 9, 2006

(54) DIELECTRIC RESONATOR ANTENNA WITH MUTUALLY ORTHOGONAL FEEDS

(75) Inventors: Simon Philip Kingsley, Sheffield (GB); Steven Gregory O'Keefe, Chambers Flat (AU)

(73) Assignee: Antenova Limited, Cambridge (GB)

( * ) Notice: Subject to any disclaimer, the term of this patent is extended or adjusted under 35 U.S.C. 154(b) by 0 days.

(21) Appl. No.: 10/470,546

(22) PCT Filed: Jan. 17, 2002

(86) PCT No.: PCT/GB02/00170

§ 371 (c)(1),
(2), (4) Date: Apr. 9, 2004

(87) PCT Pub. No.: WO02/058190

PCT Pub. Date: Jul. 25, 2002

(65) Prior Publication Data

US 2004/0155817 A1 Aug. 12, 2004

(30) Foreign Application Priority Data

Jan. 22, 2001 (GB) ..... 0101567.6

(51) Int. Cl.
*H01Q 19/10* (2006.01)
*H01Q 1/40* (2006.01)

(52) U.S. Cl. ..... 343/832; 343/911 R

(58) Field of Classification Search ..... 343/832, 343/709, 797, 873, 846, 911 R
See application file for complete search history.

(56) References Cited

U.S. PATENT DOCUMENTS

| | | | | |
|---|---|---|---|---|
| 2,872,675 | A | | 2/1959 | Kennaugh |
| 3,662,260 | A | | 5/1972 | Thomas |
| 3,683,390 | A | * | 8/1972 | Cory et al. ..... 343/792.5 |
| 4,104,634 | A | * | 8/1978 | Gillard et al. ..... 342/7 |
| 4,843,396 | A | * | 6/1989 | Macikunas et al. ..... 342/7 |
| 6,014,107 | A | * | 1/2000 | Wiesenfarth ..... 343/742 |

OTHER PUBLICATIONS

N. Inagaki, "Three-Dimensional Corner Reflector Antenna", IEEE Transactions on Antennas and Propagation, Jul. 1974, vol. AP-22, XP-002195026, New York, USA.

* cited by examiner

*Primary Examiner*—Don Wong
*Assistant Examiner*—Huedung X. Cao
(74) *Attorney, Agent, or Firm*—Garvey, Smith, Nehrbass & North, L.L.C.; Seth M. Nehrbass; Brett A. North

(57) ABSTRACT

A multi-polarisation dielectric resonator antenna (1) having three mutually orthogonal feeds (5*a*, 5*b*, 5*c*) displaying $C_{3V}$ point group symmetry is disclosed. The antenna (1) may be operated so as to determine the polarisation of any incoming signal, since the three feeds (5*a*, 5*b*, 5*c*) have polarisations at 120 degrees to each other. Furthermore, a plurality of mult dielectric resonator antennas (1) may be formed into a composite dielectric resonator antenna with beamsteering, direction feeding and polarisation detection capability over a full 4π streradians.

12 Claims, 6 Drawing Sheets

3 orthogonal probes in the octisphere

Radiation patterns transmitted from 3 orthogonal probes in a tetrahedron DRA made at 700MHz A true elevation pattern for probe 5a Radiation patterns for probe 5a in a 420 MHz 1/8th sphere antenna

DIELECTRIC RESONATOR ANTENNA WITH MUTUALLY ORTHOGONAL FEEDS

This application is the National Phase of International Application PCT/ GB 02/0017001 filed Jan. 17, 2002.

CROSS REFERENCE TO RELATED APPLICATIONS

Not applicable.

STATEMENT REGARDING FEDERALLY SPONSORED RESEARCH OR DEVELOPMENT

Not applicable.

INCORPORATION BY REFERENCE OF MATERIAL SUBMITTED ON A COMPACT DISC

Not applicable.

BACKGROUND

The present invention relates to a dielectric resonator antenna having three separate and mutually orthogonal feeds such that separate beams can be formed with different polarisations and such that the polarisation of an incoming beam can be measured.

Since the first systematic study of dielectric resonator antennas (DRAs) in 1983 [LONG, S. A., McALLISTER, M. W., and SHEN, L. C.: "The Resonant Cylindrical Dielectric Cavity Antenna", IEEE Transactions on Antennas and Propagation, AP-31, 1983, pp 406–412], interest has grown in their radiation patterns because of their high radiation efficiency, good match to most commonly used transmission lines and small physical size [MONGIA, R. K. and BHARTIA, P.: "Dielectric Resonator Antennas—A Review and General Design Relations for Resonant Frequency and Bandwidth", International Journal of Microwave and Millimetre Wave Computer-Aided Engineering, 1994, 4, (3), pp 230–247]. Most of the configurations reported have used a slab of dielectric material mounted on a ground plane excited by either an aperture feed in the ground plane or by a probe inserted into the dielectric material.

A few publications have reported experiments using two probes fed simultaneously in a circular cross-section dielectric slab. These probes were installed on radials at 90° to each other and fed in anti-phase so as to create circular polarisation [MONGIA, R. K., ITTIPIBOON, A., CUHACI, M. and ROSCOE D.: "Circular Polarised Dielectric Resonator Antenna", Electronics Letters, 1994, 30, (17), pp 1361–1362; and DROSSOS, G., WU, Z. and DAVIS, L. E.: "Circular Polarised Cylindrical Dielectric Resonator Antenna", Electronics Letters, 1996, 32, (4), pp 281–283.3, 4] and one publication included the concept of switching the probes on and off [DROSSOS, G., WU, Z. and DAVIS, L. E.: "Switchable Cylindrical Dielectric Resonator Antenna", Electronics Letters, 1996, 32, (10), pp 862–864].

The general concept of deploying a plurality of probes within a single dielectric resonator antenna, as pertaining to a cylindrical geometry, is described in the paper KINGSLEY, S. P. and O'KEEFE, S. G., "Beam Steering and Monopulse Processing of Probe-Fed Dielectric Resonator Antennas", IEE Proceedings—Radar; Sonar and Navigation, 146, 3, 121–125, 1999, the disclosure of which is incorporated into the present application by reference.

It is known from N Inagaki: "Three-dimensional corner reflector antenna", IEEE Transactions on Antennas and Propagation, Vol. AP-22, no. 7, July 1974 (1974–07), pp 580–582 to provide a reflector antenna having three mutually orthogonal planar reflectors and a unipole radiator mounted on one of the reflectors.

U.S. Pat. No. 3,662,260 discloses a probe for sensing orthogonal components of an electric field, the probe comprising a body made of a dielectric material and having mutually orthogonal passageways bored therein to receive electrode assemblies.

U.S. Pat. No. 2,872,675 discloses a radar reflector for use in radar systems comprising a conductive corner reflector filled with a dielectric material.

SUMMARY

According to a first aspect of the present invention, there is provided a dielectric resonator antenna including a grounded substrate, a dielectric resonator contacting or in close proximity to the grounded substrate, and three feeds for transferring energy into and from different regions of the dielectric resonator, characterized in that the dielectric resonator is formed as a volume having three mutually orthogonal surface planes of substantially the same size and shape, and in that the feeds contact the dielectric resonator at substantially central portions of the three surface planes such that the feeds are also mutually orthogonal.

The grounded substrate (i.e. a conductive substrate connected to ground) is preferably formed so as to be coextensive with and either in contact with or located in close proximity to each of the three mutually orthogonal surface planes (it is possible to increase the operational bandwidth of the dielectric resonator antenna by leaving a small gap between the grounded substrate and the dielectric resonator). Advantageously, the grounded substrate extends beyond an extent of the three surface planes, this configuration helping to reduce radiation backlobes during operation.

According to a second aspect of the present invention, there is provided a dielectric resonator antenna including a grounded substrate, a dielectric resonator contacting or in close proximity to the grounded substrate, and three feeds for transferring energy into and from different regions of the dielectric resonator, characterized in that the dielectric resonator is formed as a volume shaped so as to have three points at each of which a tangent plane to the volume may be defined such that the three tangent planes are mutually orthogonal, and in that the feeds contact the dielectric resonator at the three points such that the feeds are also mutually orthogonal.

In this aspect of the invention, the grounded substrate may be arranged to correspond to the three imaginary tangent planes, or be parallel thereto. Alternatively, the grounded substrate may follow any curvature of the dielectric resonator or otherwise be disposed in close proximity thereto, at least at the points where the feeds are connected to the dielectric resonator.

According to a third aspect of the present invention, there is provided a dielectric resonator antenna including a dielectric resonator, and three dipole feeds for transferring energy into and from different regions of the dielectric resonator, characterized in that the three dipole feeds are positioned in a mutually orthogonal configuration within or around the dielectric resonator and in that the dielectric resonator is shaped such that the dielectric resonator and the three dipole feeds have a three-fold rotational symmetry about a predetermined axis.

The three-fold rotational symmetry is equivalent to $C_{3v}$ point group symmetry, e.g. that of a tetrahedron.

Where the dipole feeds are positioned within the dielectric resonator, it can be difficult to supply energy to the feeds by way of wired connections. Accordingly, it is preferred to locate the dipole feeds around the dielectric resonator in a manner similar to that used for producing printed circuit boards.

The dielectric resonator may be a fluid, such as water or other dielectric liquids or gases, or may be formed out of a dielectric solid material.

The feeds may be in the form of conductive probes which are contained within, placed against, or printed or otherwise formed on the dielectric resonator.

Alternatively, the feeds may be formed as apertures provided in the grounded substrate.

Suitable shapes for the dielectric resonator of the first aspect of the present invention include a triangular tetrahedron and an eighth segment of a sphere, both of which include three mutually orthogonal surface planes of substantially the same size or shape.

The feeds are positioned in the centre of each surface plane and are arranged so as also to be mutually orthogonal.

An eighth segment of a sphere has been shown to resonate in a TE mode and to radiate like a horizontal magnetic dipole thereby giving rise to a vertically polarised cosine or figure-of-eight shaped radiation pattern. It is believed that other resonant modes may produce the same effect, the important result being the generation of a cosine shaped radiation pattern.

Similarly, a triangular tetrahedron has been shown to resonate and produce cosine shaped radiation patterns.

The important of these two (similar) geometries lies in the ability to rotate the antenna by 120° and see exactly the same picture. In the far field this means that the three feeds have polarisations at 120° to each other and the polarisation of any incoming signal can be determined. The feeds are, however, orthogonal to each other thereby permitting three independent electric field vectors of an incoming waveform to be measured. With one additional magnetic field measurement, from say a loop antenna, full direction finding capability can be achieved.

Advantageously, a composite dielectric resonator antenna may be formed by building a structure out of a number of the individual dielectric resonator antennas of the first aspect of the present invention such that each individual dielectric resonator antenna is positioned so as to detect signals from or to transmit signals to regions outside the structure. Preferably, each individual antenna is adapted to detect signals from or to transmit signals to a volume subtended by a solid angle of $\pi/2$ steradians measured about an origin defined as a centre point of the structure, the individual antennas being arranged so as to transmit signals to or detect signals from non-overlapping volumes. The structure may be substantially symmetrical. For example, eight triangular tetrahedral antennas may be fitted together to form a composite octahedral antenna; or eight eighth segments of a sphere may be fitted together to form a composite spherical antenna. In each case, the composite antenna may be arranged to give a full $4\pi$ steradian multi-polarisation antenna which is operable to detect the polarisation of an incoming beam from any angle.

With regard to the third aspect of the present invention, the dielectric resonator including the three mutually orthogonal dipole feeds may be spherical in shape, thereby providing the ability to rotate the antenna by 120° and see exactly the same picture. In the far field this means that the three feeds have polarisations at 120° to each other and the polarisation of any incoming signal can be determined. The feeds are, however, orthogonal to each other thereby permitting three independent electric field vectors of an incoming waveform to be measured. With one additional magnetic field measurement, from say a loop antenna, full direction finding capability can be achieved.

A particular advantage offered by a multi-polarisation dielectric resonator antenna as provided by embodiments of the present invention is that it can be used to transmit or receive signals in three polarisations simultaneously. For example, it may be possible to triple a rate of data communication by transmitting or receiving three different signals simultaneously in three different polarisations using the same antenna.

For a better understanding of the present invention and to show how it may be carried into effect, reference shall now be made by way of example to the accompanying drawings, in which:

DETAILED DESCRIPTION

Figure 1:
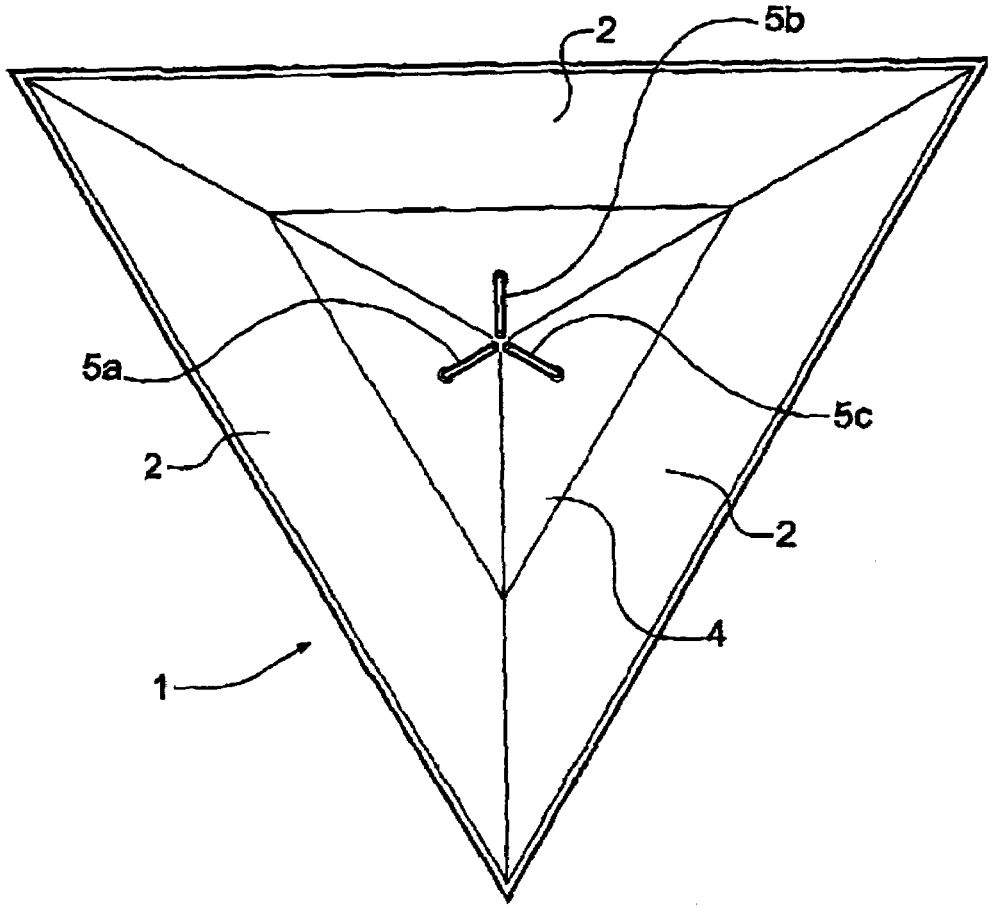
FIG. 1 shows a first view of an antenna of the present invention.
Figure 2:
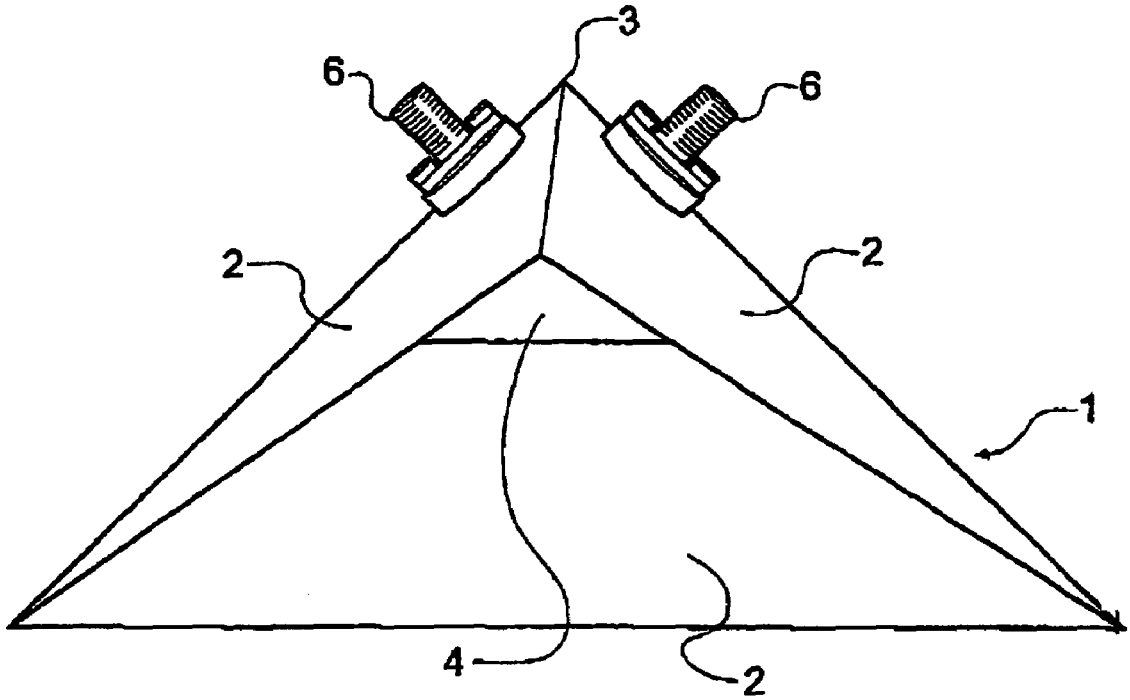
FIG. 2 shows a second view of an antenna of the present invention.

Referring firstly to FIGS. 1 and 2, there is shown a dielectric resonator antenna 1 including three triangular grounded substrates 2 fitted together in the form of a triangular tetrahedron having an apex 3 (best seen in FIG. 2). A dielectric resonator 4 also in the form of a triangular tetrahedron, is located snugly in the apex 3 of the substrates 2, extending about half way along each substrate 2. The dielectric resonator 4 in this embodiment comprises a volume of water sealed in place by a triangular plastics cover. Three mutually orthogonal probe feeds 5*a*, 5*b* and 5*c* extend, one through each substrate 2, into a central region of the dielectric resonator 4. It is to be noted that each probe feed 5 is normal to the face of the tetrahedral resonator 4 through which is passes, and is also centrally located therein so that the dielectric resonator 4 and the probe feeds 5 display three-fold rotational symmetry ($C_{3v}$ point group symmetry) about an axis taken through the centre of the dielectric resonator 4 and the apex 3.

As seen best in FIG. 2, each probe feed 5 passes through and is connected to a substrate 2, and is provided with a connector 6 enabling connection to external electrical equipment (not shown).

Figure 3:
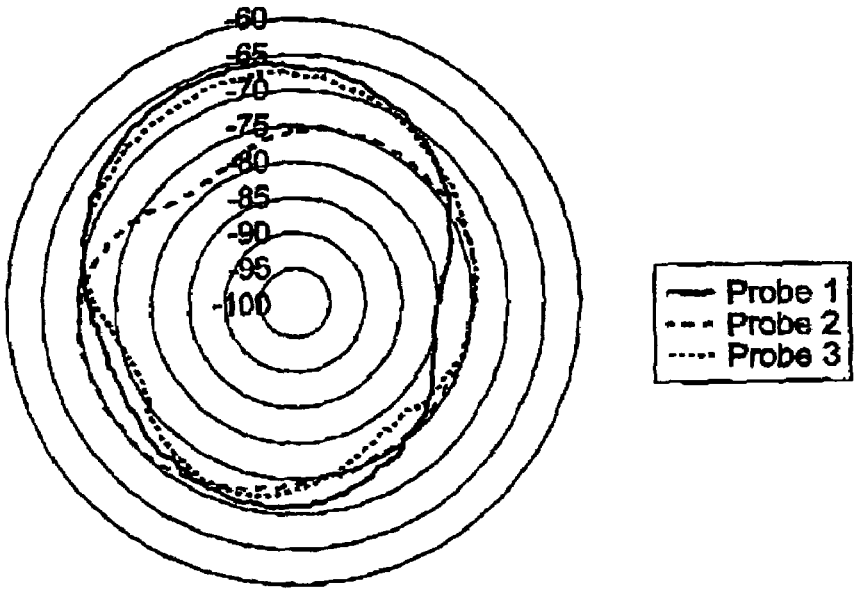
FIG. 3 shows the radiation patterns transmitted from the antenna of FIGS. 1 and 2.

Experimental results for the antenna 1 of FIGS. 1 and 2 operated at 700 MHz are shown in FIG. 3. A signal was transmitted on the antenna 1 and received by a dipole (not shown) some distance away in an anechoic chamber (not shown). The antenna 1 was placed with one substrate 2 flat on a rotating platform (not shown) such that azimuth patterns could be measured. Probe feed 5*a* projected vertically through the substrate 2 placed flat on the platform, probe feed 5*b* projected horizontally from the right hand side (as viewed from the receiving monopole and probe feed 5*c* horizontally from the left hand side. The receiving monopole was used with vertical polarisation to measure probe feed 5*a* and horizontal polarisation for probe feeds 5*b* and 5*c*.

Figure 4:
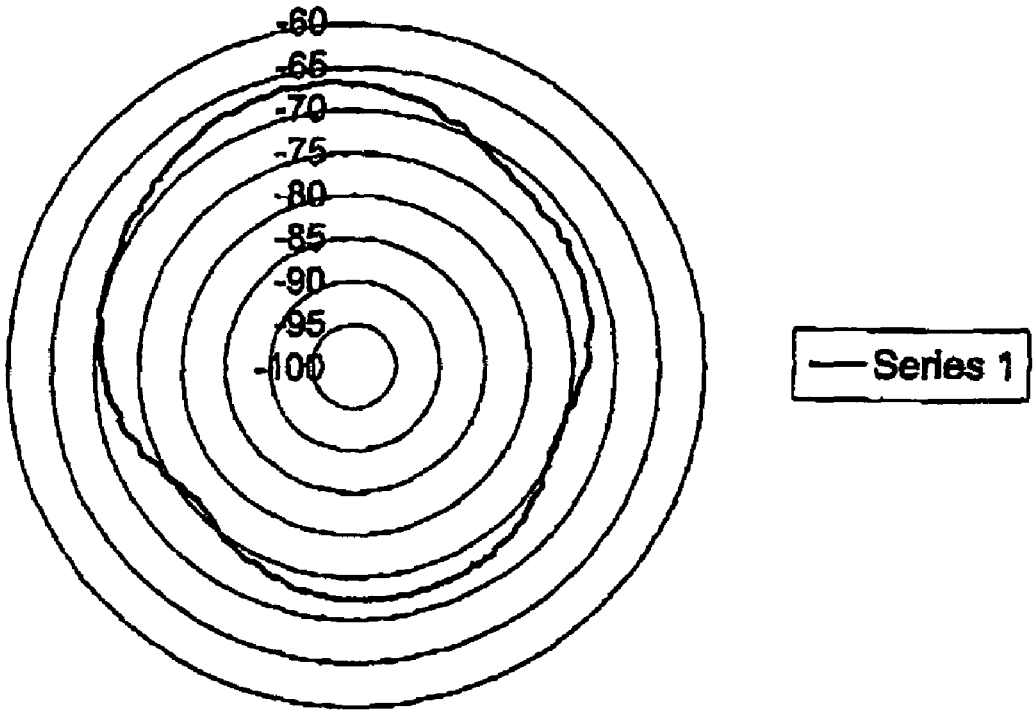
FIG. 4 shows a true elevation radiation pattern for a single probe of the antenna of FIGS. 1 and 2.
Figure 5:
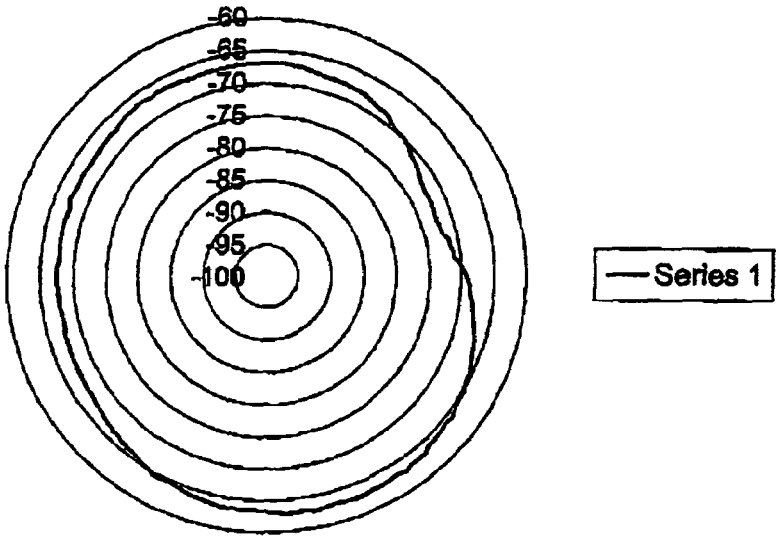
FIG. 5 shows the radiation pattern for a single probe of an antenna having the form of an eighth segment of a sphere.

When rotating the platform on which the antenna 1 was mounted so as to provide azimuth scans, this took different cuts through the radiation patterns of the three probes 5*a*, 5*b* and 5*c*, as shown in FIG. 3. None of these three cuts, however, corresponded to a true elevation scan. Consequently, the antenna 1 was repositioned on the platform such that probe 5*a* was rotate through 90 so that a true elevation (rather than azimuth) pattern for probe 5*a* could be determined, the results being shown in FIG. 4.

Figure 6:
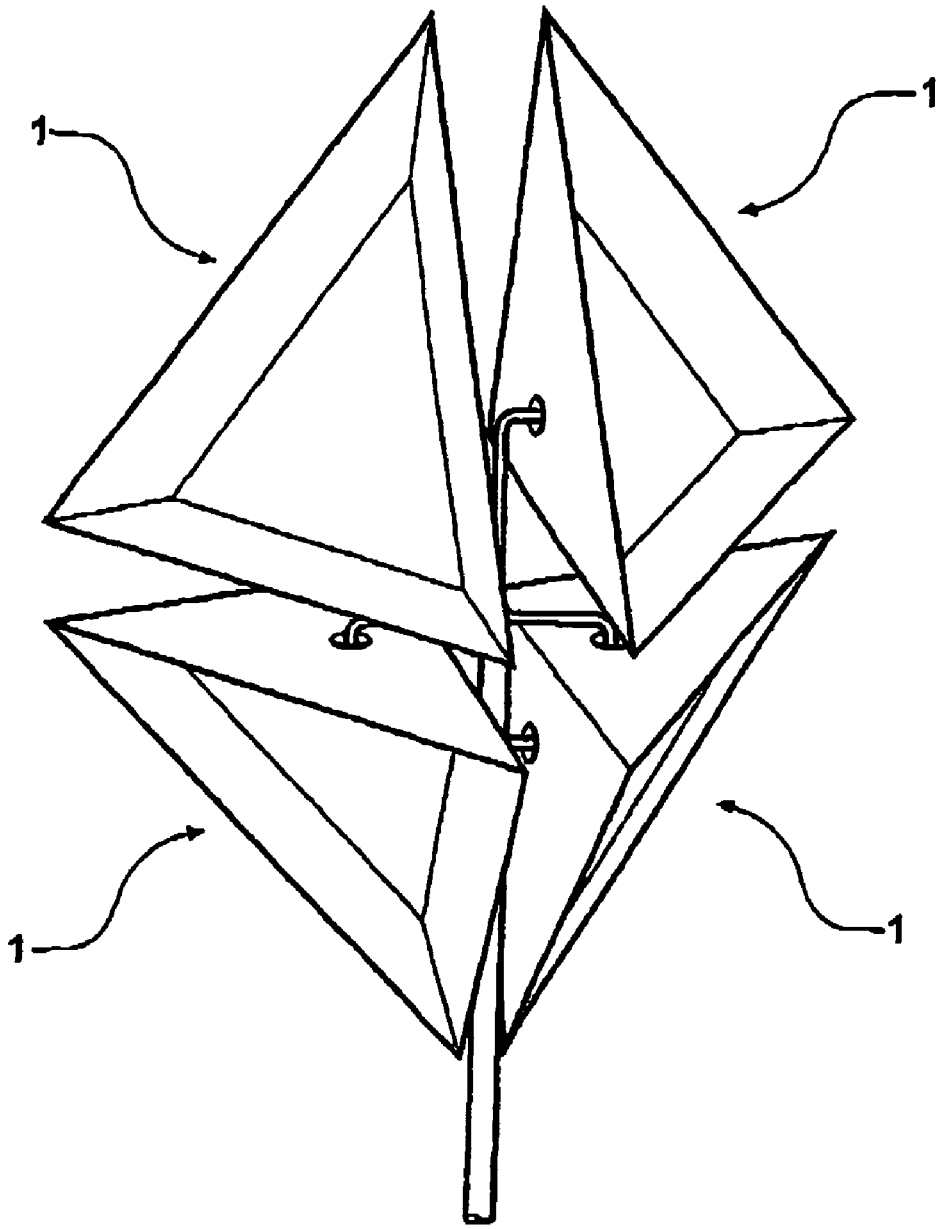
FIG. 6 is an exploded view of a composite antenna formed of four antennae of the type shown in FIGS. 1 and 2.

An antenna having the form of an eighth segment of a sphere was constructed and tested at 420 MHz, the radiation pattern for a vertical feed probe 6*a* as the antenna was rotated on the platform being shown in FIG. 6.

FIG. 6 shows a composite dielectric resonator antenna formed of four dielectric resonator antennas 1 of the type shown in FIGS. 1 and 2. The antennas 1 are assembled so as to form a semi-octahedral structure as shown, the composite antenna thus formed being capable of beamsteering and detection over a complete hemisphere. As will be clear from FIG. 6, a further four dielectric resonator antennas 1 may be added to the assembly so as to form a full octahedral structure with beamsteering and detection capability over a complete sphere, that is, in any direction. Furthermore, it is thus possible to determine the polarisation of an incoming beam from any angle.

The invention claimed is:

1. A dielectric resonator antenna including a grounded substrate, a dielectric resonator contacting or in close proximity to the grounded substrate, and three feeds for transferring energy into and from different regions of the dielectric resonator, characterized in that the dielectric resonator is formed as a volume having three mutually orthogonal surface planes of substantially the same size and shape, and in that the feeds contact the dielectric resonator at substantially central portions of the three surface planes such that the feeds are also mutually orthogonal.

2. An antenna as claimed in claim 1, wherein the grounded substrate is formed so as to be coextensive with each of the three surface planes.

3. An antenna as claimed in claim 1, wherein the grounded substrate extends beyond an extent of the three surface planes.

4. An antenna as claimed in claim 1, wherein the dielectric resonator is formed as a triangular tetrahedron.

5. An antenna as claimed in claim 1, wherein the dielectric resonator is formed as an eighth segment of a sphere.

6. A composite dielectric resonator antenna structure comprising an antenna of claim 1 and further including at least one additional antenna,wherein each individual antenna, when activated, transmits signals to or detects signals from a volume subtended by a solid angle of substantially $\pi/2$ steradians measured from an origin at a central region of the structure, the plurality of antennas being arranged so as to transmit signals to or to detect signals from non-overlapping volumes.

7. A dielectric resonator antenna including a grounded substrate, a dielectric resonator contacting or in close proximity to the grounded substrate, and three feeds for transferring energy into and from different regions of the dielectric resonator, characterized in that the dielectric resonator is formed as a volume shaped so as to have three points at each of which a tangent plane to the volume may be defined such that the three tangent planes are mutually orthogonal, and in that the feeds contact the dielectric resonator at the three points such that the feeds are also mutually orthogonal.

8. An antenna as claimed in claim 7, wherein the grounded substrate contacts the dielectric resonator.

9. An antenna as claimed in claim 7, wherein the grounded substrate is spaced from the dielectric resonator.

10. A dielectric resonator antenna including a dielectric resonator, and three dipole feeds for transferring energy into and from different regions of the dielectric resonator, characterized in that the three dipole feeds are positioned in a mutually orthogonal configuration within or around the dielectric resonator and in that the dielectric resonator is shaped such that the dielectric resonator and the three dipole feeds have three-fold rotational symmetry about a predetermined axis.

11. An antenna as claimed in claim 10, wherein the three feeds, when activated, generate signals that have respective polarizations oriented at 120° to each other in far field conditions.

12. An antenna as claimed in claim 10, wherein the three feeds, when activated, detect polarisation components of incoming signals in three axes oriented at 120° to each other.

* * * * *